US010422483B2

(12) United States Patent
Cook

(10) Patent No.: US 10,422,483 B2
(45) Date of Patent: Sep. 24, 2019

(54) WELL ISOLATION UNIT

(71) Applicant: FMC Technologies, Inc., Houston, TX (US)

(72) Inventor: James Cook, Houston, TX (US)

(73) Assignee: FMC Technologies, Inc., Houston, TX (US)

( * ) Notice: Subject to any disclaimer, the term of this patent is extended or adjusted under 35 U.S.C. 154(b) by 0 days.

(21) Appl. No.: 15/943,016

(22) Filed: Apr. 2, 2018

(65) Prior Publication Data

US 2018/0283618 A1 Oct. 4, 2018

Related U.S. Application Data

(60) Provisional application No. 62/480,831, filed on Apr. 3, 2017.

(51) Int. Cl.

| | |
|---|---|
| ***F17D 5/00*** | (2006.01) |
| ***E21B 43/26*** | (2006.01) |
| ***E21B 21/08*** | (2006.01) |

(52) U.S. Cl.

CPC ..... *F17D 5/00* (2013.01); *E21B 21/08* (2013.01); *E21B 43/26* (2013.01)

(58) Field of Classification Search

CPC ..... E21B 21/08; E21B 43/26; F17D 5/00

See application file for complete search history.

(56) References Cited

U.S. PATENT DOCUMENTS

| | | | | |
|---|---|---|---|---|
| 4,299,278 | A | 11/1981 | Beehler | |
| 6,227,298 | B1 | 5/2001 | Patel | |
| 8,434,638 | B2 * | 5/2013 | McKenzie | E21B 43/26 220/1.5 |
| 8,813,848 | B2 | 8/2014 | Frazier | |
| 2011/0048695 | A1 * | 3/2011 | Cherewyk | E21B 21/062 166/90.1 |
| 2014/0352951 | A1 | 12/2014 | Suter et al. | |
| 2015/0292297 | A1 | 10/2015 | Kajaria et al. | |
| 2016/0032703 | A1 | 2/2016 | Broussard et al. | |
| 2017/0212535 | A1 * | 7/2017 | Shelman | E21B 43/26 |
| 2017/0370199 | A1 | 12/2017 | Witkowski et al. | |

FOREIGN PATENT DOCUMENTS

| | | | |
|---|---|---|---|
| WO | 2000029715 | A1 | 5/2000 |

* cited by examiner

*Primary Examiner* — James G Sayre
(74) *Attorney, Agent, or Firm* — Osha Liang LLP

(57) ABSTRACT

A well isolation unit has an inlet, an outlet, at least one flow pathway connected between the inlet and the outlet, and at least one bleed-off manifold connected between the inlet and the outlet. A method includes isolating well-side equipment of a wellbore operation system from pump-side equipment of the wellbore operation system, wherein the pump-side equipment is connected to a well isolation unit via a single primary inlet to the well isolation unit and the well-side equipment is connected to the well isolation unit via a single primary outlet of the well isolation unit.

16 Claims, 3 Drawing Sheets

WELL ISOLATION UNIT

CROSS-REFERENCE TO RELATED APPLICATIONS

This application claims benefit, under 35 U.S.C. § 119, of U.S. Provisional Application Ser. No. 62/480,831 filed on Apr. 3, 2017 and entitled "Well Isolation Unit." The disclosure of this U.S. Provisional Application is incorporated herein by reference in its entirety.

BACKGROUND

Well isolation valves are included between well-side equipment and pump-side equipment in wellbore operation systems. Well isolation valves must be included in every wellbore operation system used to pump fluid (e.g., liquid, gas or mixtures thereof) from a wellbore to ensure safety of the operation.

In typical wellbore operation systems, multiple lines of piping components with small inner diameters are used to carry fluid between a wellbore and one or more pumps. In such systems, a well isolation valve must be disposed in-line with the piping components. If it is necessary to isolate the well-side equipment from the pump-side equipment, each isolation valve must be configured to have a closed configuration. Such configuration is usually performed manually.

It may also be necessary to bleed off pressure from the well-side equipment and/or from the pump-side equipment. Bleeding off pressure may prevent wellbore fluid from leaking into the environment or may prevent damage to the wellbore operation system equipment. A holding vessel may be attached to either the pump-side equipment or to the well-side equipment to contain the fluid which flows out of the equipment when the pressure is bled off. A different holding vessel may be attached to each side of the equipment when the equipment is set up before the wellbore operation begins. It may not be possible to connect both sides of the equipment to the same holding vessel.

Isolating the well-side equipment from the pump-side equipment and bleeding pressure off from either side may be time-consuming. Connecting and testing the well isolation valves and the holding vessels on site may also be time-consuming. Further, the equipment required to house the well isolation valves may take up a significant amount of space.

SUMMARY OF THE DISCLOSURE

This summary is provided to introduce a selection of concepts that are further described below in the detailed description. This summary is not intended to identify key or essential features of the claimed subject matter, nor is it intended to be used as an aid in limiting the scope of the claimed subject matter.

In one aspect, embodiments of the present disclosure relate to a well isolation unit having an inlet, an outlet, at least one flow pathway connected between the inlet and the outlet, and at least one bleed-off manifold connected between the inlet and the outlet.

In another aspect, embodiments of the present disclosure relate to a wellbore operation system that includes at least one pump, a well isolation unit, well-side equipment disposed between a wellbore and the well isolation unit, and pump-side equipment disposed between the at least one pump and the well isolation unit, where the well isolation unit may have an inlet, an outlet, at least one flow pathway connected between the inlet and the outlet, and at least one bleed-off manifold connected between the inlet and the outlet.

In yet another aspect, embodiments of the present disclosure relate to a method that includes isolating well-side equipment of a wellbore operation system from pump-side equipment of the wellbore operation system, wherein the pump-side equipment is connected to a well isolation unit via a single primary inlet to the well isolation unit and the well-side equipment is connected to the well isolation unit via a single primary outlet of the well isolation unit.

Other aspects and advantages will be apparent from the following description and the appended claims.

DETAILED DESCRIPTION

Figure 1:
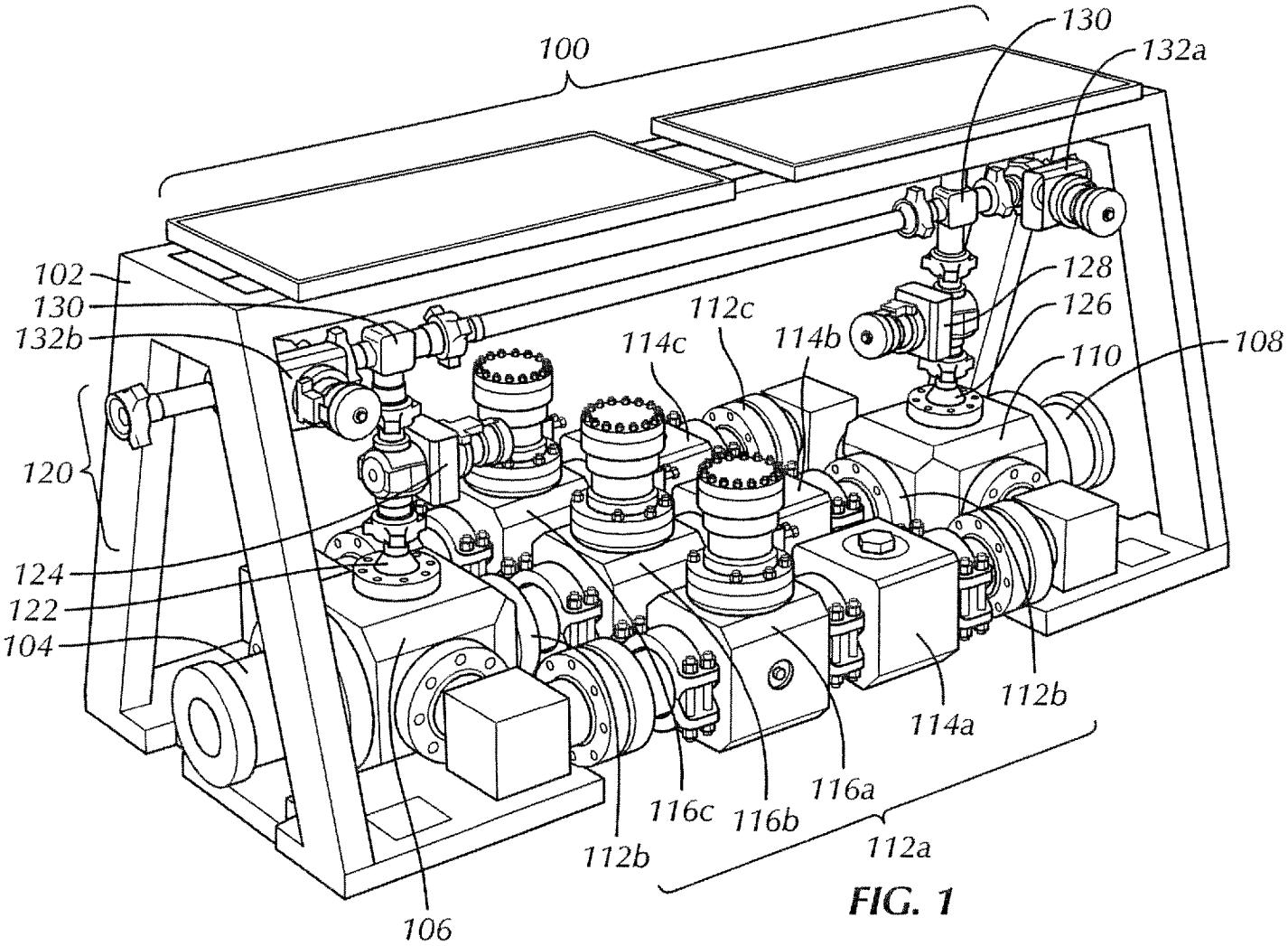
FIG. 1 is a perspective view of a well isolation unit in accordance with the present disclosure.

Embodiments of the present disclosure will now be described in detail with reference to the accompanying Figures. Like elements in the various figures may be denoted by like reference numerals for consistency. Further, in the following detailed description of embodiments of the present disclosure, numerous specific details are set forth in order to provide a more thorough understanding of the claimed subject matter. However, it will be apparent to one of ordinary skill in the art that the embodiments disclosed herein may be practiced without these specific details. In other instances, well-known features have not been described in detail to avoid unnecessarily complicating the description. Additionally, it will be apparent to one of ordinary skill in the art that the scale of the elements presented in the accompanying Figures may vary without departing from the scope of the present disclosure.

As used herein, the term "coupled" or "coupled to" or "connected" or "connected to" may indicate establishing either a direct or indirect connection, and is not limited to either unless expressly referenced as such.

Embodiments disclosed herein may generally relate to a wellbore operation system including a well isolation unit for use in wellbore operations. A wellbore operation system may include well-side equipment. Well-side equipment may include equipment disposed in a wellbore and equipment disposed between the wellbore and the well isolation unit. A wellbore operation system may also include pump-side equipment. Pump-side equipment may include one or more pumps and equipment disposed between the one or more pumps and the well isolation unit.

Further, embodiments disclosed herein may generally relate to a well isolation unit for use in wellbore operations. Well isolation units according to embodiments of the present disclosure may be connected inline with a high-pressure manifold used in wellbore operations via a single primary inlet and a single primary outlet to perform both well-side and pump-side isolation and automated bleed off.

FIG. 1 shows an example of a well isolation unit 100 according to embodiments of the present disclosure. The well isolation unit 100 may include a single inlet 104 and a single outlet 108. In some embodiments, the inlet 104 may be connected to well-side equipment used in a wellbore operation (e.g., to zipper manifolds in a fracturing operation). The inlet 104 may be configured to mate with a connection to the well-side equipment to form a high-pressure seal. In some embodiments, the inlet 104 may be connected to pump-side equipment used in a well-bore operation. The inlet 104 may be configured to mate with the pump-side equipment to form a high-pressure seal.

One or more intermediate flow pathways, 112*a*, 112*b*, and 112*c* may be fluidly connected between the inlet 104 and the outlet 108. An exemplary intermediate flow pathway 112*a* may include a check valve 114*a* and a plug valve 116*a*. The plug valve 116*a* may be disposed proximate the inlet 104 and the check valve 114*a* may be disposed proximate the outlet 108.

The check valve 114*a* may be configured to allow fluid to flow from the inlet 104 to the outlet 108 and to prevent fluid from flowing from the outlet 108 to the inlet 104. In some embodiments, the check valve 114*a* may be any means known in the art that allows fluid flow in a first direction and prevents fluid flow in a second direction. The check valve 114*a* may allow fluid to flow from the inlet 104 to the outlet 108 and prevent fluid from flowing from the outlet 108 to the inlet 104, regardless of the type of check valve used. In this way, the check valve 114*a* may prevent any flow of fluid from the pump-side equipment to the well-side equipment.

The plug valve 116*a* may be any type of plug valve known in the art. The plug valve 116*a* may include an inlet, an outlet, and an internal plug, which may have a cylindrical or conical shape, having a flow passageway. The internal cylinder or cone may be rotatable. In some embodiments, the internal cylinder or cone may be rotatable by an external handle. The internal cylinder or cone may be able to be rotated so that the plug valve 116*a* is in an open configuration, in which the flow passageway is in fluid communication with the inlet and outlet of the plug valve, and so that the plug valve 116*a* is in a closed configuration, in which the flow passageway is not aligned with/closed off from the inlet and outlet of the plug valve. In some embodiments, rotating the internal cylinder or cone a selected fraction of a full rotation (e.g., one-fourth of a full rotation) may change the configuration of the plug valve 116*a* from open to closed or vice versa. In some embodiments, the plug valve may include a mechanism which limits the motion of the internal cylinder or cone and the external handle to a selected fraction of a full rotation to open and close the plug valve. The plug valve 116*a* may be capable of stopping a high-pressure flow of liquid in the closed configuration. In some embodiments, the plug valve 116*a* may be a hydraulically actuated ULT plug valve. In some embodiments, another type of valve, such as a ball valve, a gate valve, a globe valve, or a diaphragm valve, for example, may be used instead of the plug valve 116*a*. In some embodiments, one or more valve which is capable of allowing, preventing, and restricting flow of fluid through the intermediate flow pathway 112*a* may be used.

In some embodiments, the well isolation unit may include three intermediate flow pathways 112*a*, 112*b*, and 112*c* connected to and extending between the inlet 104 and the outlet 108 in parallel. Each intermediate flow pathway 112*a*, 112*b*, and 112*c* may include a check valve 114*a*, 114*b*, and 114*c* and a plug valve 116*a*, 116*b*, and 116*c*, as described above for the exemplary intermediate flow pathway 112*a*. In some embodiments, identical check valves 114*a*, 114*b*, and 114*c* may be used in each intermediate flow pathway 112*a*, 112*b*, and 112*c*. In some embodiments, different check valves 114*a*, 114*b*, and 114*c* may be used in each intermediate flow pathway 112*a*, 112*b*, and 112*c*. In some embodiments, identical plug valves 116*a*, 116*b*, and 116*c* may be used in each intermediate flow pathway 112*a*, 112*b*, and 112*c*. In some embodiments, different plug valves 116*a*, 116*b*, and 116*c* may be used in each intermediate flow pathway 112*a*, 112*b*, and 112*c*. Well isolation units in accordance with embodiments of the present disclosure may include any number of flow pathways, each flow pathway including one or more valves (e.g., a check valve and a plug valve, as described above for the exemplary intermediate flow pathway 112*a*).

In some embodiments, an inlet block 106 may be connected between the inlet 104 and the one or more intermediate flow pathways 112*a*, 112*b*, and 112*c*. The inlet block 106 may have a single inlet connection and may have a number of outlet connections which is equal to the number of intermediate flow pathways 112*a*, 112*b*, and 112*c*. The inlet 104 may be connected to the inlet connection of the inlet block 106. The intermediate flow pathways 112*a*, 112*b*, and 112*c*, may be connected to the outlet connections of the inlet block 106. The inlet connection of the inlet block 106 may be configured to mate with the inlet 104 to form a high-pressure seal. The outlet connections of the inlet block 106 may be configured to mate with the one or more intermediate flow pathways 112*a*, 112*b*, and 112*c*, to form high pressure seals.

In some embodiments, other connection types and/or other inlet block configurations may be used to connect the inlet 104 to the one or more intermediate flow pathways 112*a*, 112*b*, and 112*c*.

In some embodiments, an outlet block 110 may be connected between the outlet 108 and the one or more intermediate flow pathways 112*a*, 112*b*, and 112*c*. The outlet block 110 may have a single outlet connection and may have a number of inlet connections which is equal to the number of intermediate flow pathways 112*a*, 112*b*, and 112*c*. The outlet 108 may be connected to the outlet connection of the outlet block 110. The intermediate flow pathways 112*a*, 112*b*, and 112*c*, may be connected to the inlet connections of the outlet block 110. The outlet connection of the outlet block 110 may be configured to mate with the outlet 110 to form a high-pressure seal. The inlet connections of the outlet block 110 may be configured to mate with the one or more intermediate flow pathways 112*a*, 112*b* and 112*c*, to form high pressure seals.

In some embodiments, other connection types and/or other outlet block configurations may be used to connect the outlet 110 to the one or more intermediate flow pathways 112*a*, 112*b*, and 112*c*.

In some embodiments, any means known in the art may be used to connect the inlet 104 and one or more intermediate flow pathways 112*a*, 112*b*, and 112*c*. In some embodiments, any means known in the art may be used to connect the outlet 108 and one or more intermediate flow pathways 112*a*, 112*b*, and 112*c*.

In some embodiments, the inlet 104, the outlet 108, and the one or more intermediate flow pathways 112*a*, 112*b*, and 112*c* may have any inner diameter. The inlet 104 and the outlet 108 may have the same inner diameter. The one or more intermediate flow pathways 112*a*, 112*b*, and 112*c* may have the same inner diameter as the inlet 104 and the outlet 108 or may have a different inner diameter than the inlet 104 and the outlet 108. There may be any number of fluid flow pathways connected between the inlet 104 and the outlet 108.

In some embodiments, the inlet 104 and/or the outlet 108 may have an inner diameter that is larger than a standard diameter for piping components in wellbore operations. For example, in some embodiments, the inlet 104 and/or the outlet 108 may have an inner diameter of about seven inches. In some embodiments, the inlet 104 and/or the outlet 108 may have an inner diameter of seven and one sixteenth inches. The inner diameter of the inlet 104 and/or the outlet 108 may be dictated by API 6A. In embodiments having an inlet and/or outlet with a relatively larger inner diameter than a standard piping diameter, intermediate flow passageways extending between the inlet and outlet may have an inner diameter smaller than the inner diameter of the inlet and outlet. For example, in some embodiments, the one or more intermediate flow passageways 112*a*, 112*b*, and 112*c* may have an inner diameter of four inches.

In some embodiments, the one or more intermediate flow passageways 112*a*, 112*b*, and 112*c* may be composed of standard components which are not designed specifically for the well isolation unit. En the embodiment shown, there may be three intermediate flow pathways 112*a*, 112*b*, and 112*c* extending between the inlet 104 and the outlet 108 to accommodate the fluid volume used in the wellbore operation, given the reduced inner diameters of the valves disposed along the intermediate flow pathways compared to the relatively larger inner diameters of the inlet and outlet bores. In some embodiments, there may be more or less than three intermediate flow pathways between the inlet and the outlet of well isolation units according to embodiments of the present disclosure.

In some embodiments, there may be more or less than three intermediate flow pathways between a single inlet and a single outlet of a well isolation unit. For example, a well isolation unit may have a single intermediate flow pathway extending between a single inlet and a single outlet of the well isolation unit when the inner diameter of the inlet and the outlet is equal to the inner diameter of the intermediate flow pathway and to the inner diameter of the valves disposed along the intermediate flow pathway (e.g., an inner diameter of about seven inches or other selected piping size being used in the wellbore operation). In embodiments using relatively larger valves along intermediate flow pathways (valves with flow pathways having an inner diameter equal to or larger than the inner diameter of the inlet and outlet bores), redundant intermediate flow pathways may be avoided. In other examples, a well isolation unit may have more than one intermediate flow pathway (e.g., two intermediate flow pathways, three intermediate flow pathways, or more than three intermediate flow pathways) extending between a single inlet and a single outlet of the well isolation unit, where the multiple intermediate flow pathways may each have one or more valves with inner diameter flow paths that are smaller than the inner diameters of the inlet and outlet.

The volume flow rate of fluid through the inlet 104 may be similar to or greater than the total volume flow rate of fluid through the one or more intermediate flow pathways 112*a*, 112*b*, and 112*c*. The volume flow rate of fluid through the outlet 108 may be similar to or greater than the total volume flow rate of fluid through the one or more intermediate flow pathways 112*a*, 112*b*, and 112*c*. The total volume flow rate of fluid through the one or more intermediate flow pathways 112*a*, 112*b*, and 112*c* may be calculated as the sum of the individual volume flow rates through each of the one or more intermediate flow pathways 112*a*, 112*b*, and 112*c*. The one or more flow pathways 112*a*, 112*b*, and 112*c* may have the same inner diameter or may have different inner diameters. Likewise, the one or more intermediate flow pathways 112*a*, 112*b*, and 112*c* may have the same individual volume flow rates or different individual volume flow rates.

The well isolation unit 100 may further include a bleed-off manifold 120. The bleed-off manifold 120 may include a configuration of piping providing multiple fluid paths therethrough. For example, in the embodiment shown in FIG. 1, the bleed-off manifold 120 may include an inlet connector 122 connected to the inlet block 106, thereby providing a fluid path from the junction between inlet 104 and the intermediate flow pathways 112*a*, 112*b*, 112*c*, and an outlet connector 126 connected to the outlet block 110, thereby providing a fluid path from the junction between the outlet 108 and the intermediate flow pathways 112*a*, 112*b*, 112*c*. In embodiments utilizing other types or configurations of junctions between the inlet/outlet of the well isolation unit and the intermediate flow pathway(s), a bleed-off manifold may similarly include an inlet connector connected at the junction between the inlet and intermediate flow pathway(s) and an outlet connector connected at the junction between the outlet and intermediate flow pathway(s).

Referring still to FIG. 1, the bleed-off manifold 120 may include a first bleed off manifold valve 124 disposed between the inlet connector 122 and a main passageway 130. The first bleed off manifold valve 124 may be any type of valve known in the art. The first bleed off manifold valve 124 may have an open configuration and a closed configuration. Configuring the first bleed off manifold valve 124 in the open configuration may allow fluid to flow from the inlet 104, the inlet block 106, and the inlet connector 122 into the main passageway 130. Configuring the first bleed off manifold valve 124 in the closed configuration may prevent fluid from flowing from the inlet 104, the inlet block 106, and the inlet connector 122 into the main passageway 130.

The bleed-off manifold 120 may further include a second bleed off manifold valve 128, disposed between the outlet connector 126 and the main passageway 130. The second bleed off manifold valve 128 may be any type of valve known in the art. The second bleed off manifold valve 128 may have an open configuration and a closed configuration. Configuring the second bleed off manifold valve 128 in the open configuration may allow fluid to flow from the outlet 108, the outlet block 110, and the outlet connector 126 into the main passageway 130. Configuring the second bleed off manifold valve 128 in the closed configuration may prevent fluid from flowing from the outlet 108, the outlet block 110, and the outlet connector 126 into the main passageway 130.

The bleed-off manifold 120 may include one or more bleed-off outlets 132*a* and 132*b*. The one or more bleed-off outlets 132*a* and 132*b* may be connected to any point of the main passageway 130. Further, the bleed-off outlets 132*a* and 132*b* may be positioned along the bleed-off manifold 120 such that the first bleed off manifold valve 124 is positioned between the bleed-off outlets 132*a*, 132*b* and the inlet 104, and such that the second bleed off manifold valve 128 is positioned between the bleed-off outlets 132*a*, 132*b* and the outlet 108. The one or more bleed-off outlets 132*a* and 132*b* may allow the flow of fluid from the main passageway 130 to an external holding vessel. In some embodiments, such as shown in FIG. 1, there may be two bleed-off outlets 132*a* and 132*b*. In other embodiments, there may be one bleed-off outlet, or in some embodiments, there may be more than two bleed-off outlets. An external holding vessel may be a tank (e.g., one or more pop-off/bleed-off tank(s)), a pit, or any other means known in the art of holding wellbore fluid.

The bleed-off outlets 132*a* and 132*b* may be configured such that each of the bleed-off outlets 132*a* and 132*b* directs fluid to a different external holding vessel. The well isolation unit 100 may be configured such that fluid from wellbore equipment connected to the inlet 104, well-side equipment, for example, may be directed to flow through any of the one or more bleed-off outlets 132*a* and 132*b*. For example, as shown in FIG. 1, fluid may flow from pump-side equipment into the inlet 104 of the well isolation unit 100, through the inlet block 106, through the inlet connector 122, through the first bleed off manifold valve 124 (when open), into the main passageway 130, and out of one or both of the bleed-off outlets 132*a*, 132*b* (depending on if one or both of the bleed-off outlets 132*a*, 132*b* are open). Further, the well isolation unit 100 may be configured such that fluid from wellbore equipment connected to the inlet 104, pump-side equipment, for example, may be directed to flow through any of the one or more bleed-off outlets 132*a* and 132*b*. For example, as shown in FIG. 1, fluid may flow from pump-side equipment into the inlet 104 of the well isolation unit 100, through the inlet block 106, through the inlet connector 122, through the first bleed off manifold valve 124 (when open), into the main passageway 130, and out of one or both of the bleed-off outlets 132*a*, 132*b* (depending on if one or both of the bleed-off outlets 132*a*, 132*b* are open).

One or more of the bleed-off outlets 132*a* and 132*b* may include a valve such as a choke valve. The first bleed off manifold valve 124 and/or the second bleed off manifold valve 128 may also include a choke valve. The choke valve may have an open configuration and a closed configuration. Configuring one or more of the bleed-off outlets 132*a* and 132*b* to have an open configuration may allow fluid to flow out of main passageway 130 and into an external holding vessel. The choke valve may be designed to withstand extreme conditions, including erosion, corrosion, and high pressures. The choke valve may be rated to withstand up to 15,000 PSI Cold Working Pressure.

One or more of the valves included in the well isolation unit 100 may be automated. A valve that is automated may be configured to have an open configuration or to have a closed configuration based on a user input, on a measurement of wellbore operation conditions, a configuration of another valve or set of valves, a configuration of other wellbore equipment, or any other input. A measurement of wellbore operation conditions may be made within the well isolation unit 100, within a wellbore connected to the well isolation unit 100, or within any piece of equipment connected to the well isolation unit 100 or used for the wellbore operation. In example embodiments, one or more of the plug valves 116*a*, 116*b*, and 116*c* may be automated, the first bleed off manifold valve 124 of the bleed-off manifold 120 may be automated, the second bleed off manifold valve 128 of the bleed-off manifold 120 may be automated, and/or one or more of the bleed-off outlets 132*a* and 132*b* of the bleed-off manifold 120 may be automated. Any combination of the valves of the well isolation unit 100 may be automated. Any control system or combination of control systems known in the art may be used to control the automated valves.

Figure 2:
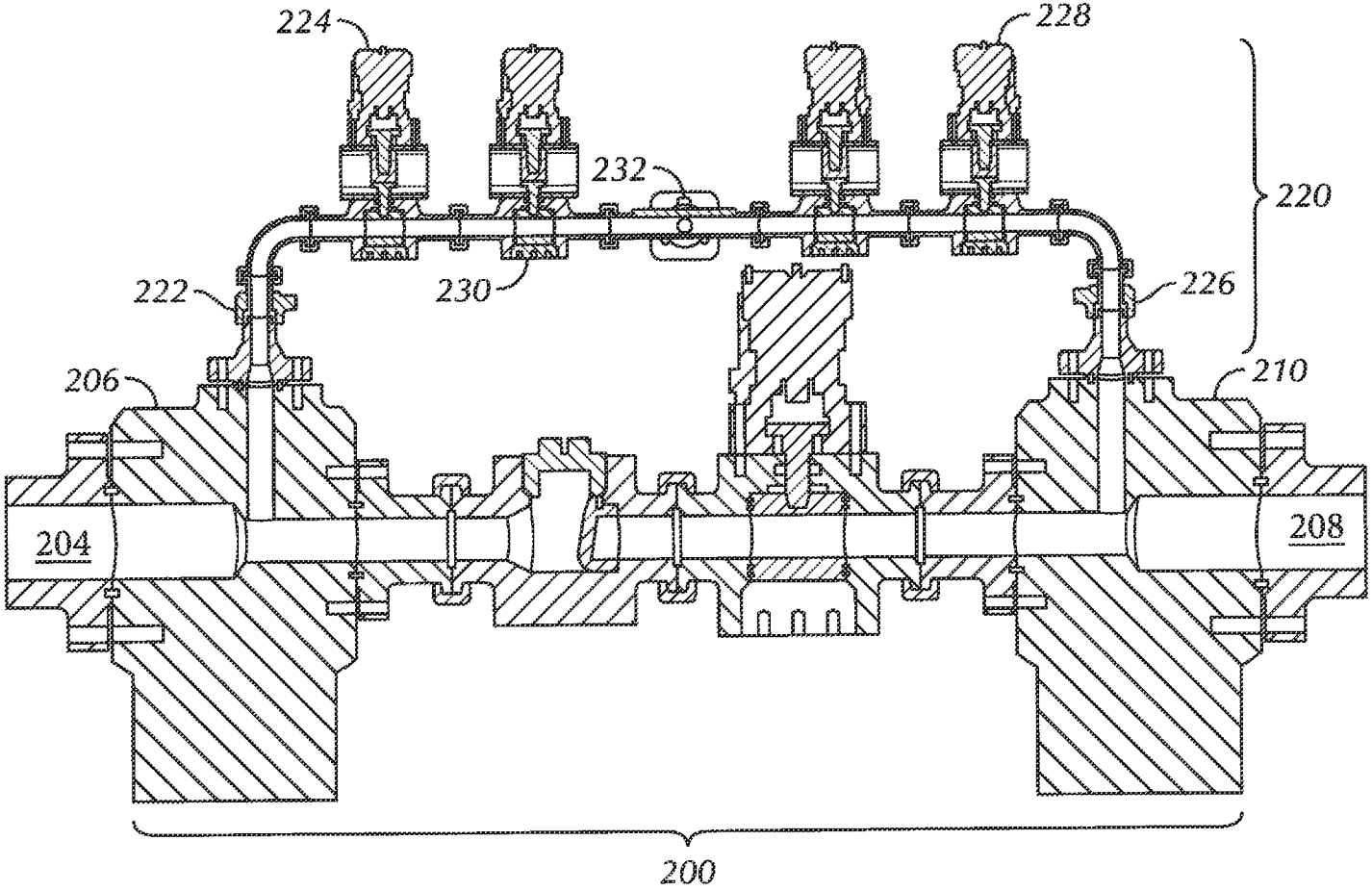
FIG. 2 is a cross-section view of a well isolation unit in accordance with the present disclosure.

Referring now to FIG. 2, FIG. 2 shows a cross-section view of a well isolation unit 200 including a bleed-off manifold 220 having an alternate configuration from that shown in FIG. 1. A single bleed-off outlet 232 is connected to the main passageway 230 between the first bleed off manifold valve 224 and the second bleed off manifold valve 228. The inlet connector 222, disposed between the inlet block 206 and the first bleed off manifold valve 224, is elongated, compared to the inlet connector 122 shown in FIG. 1. The outlet connector 226, disposed between the outlet block 210 and the second bleed off manifold valve 228, is elongated, compared to the outlet connector 126 shown in FIG. 1.

In some embodiments, the inlet 204 and the outlet 208 of the well isolation unit 200 may have a diameter of about seven inches. Piping components of other wellbore operation equipment which is part of the wellbore operation system may have a diameter of about seven inches. The fluid flow rate may be the same throughout a flow path extending through the wellbore operation system.

In some embodiments, the wellbore operation system may include one or more bleed-off tank units. For example, the bleed off outlet 232 may include a variable choke valve. The discharge of the choke valve may discharge to the sides of the well isolation unit 100. In some embodiments, the bleed-off outlet 232 may be configured to mate with an inlet of an alternate external holding vessel.

FIGS. 1 and 2 show examples of different configurations of well isolation units according to embodiments of the present disclosure. However, other configurations of well isolation units may be envisioned having a single primary inlet, a single primary outlet, one or more valved intermediate flow pathways extending between the single primary inlet and single primary outlet, and a bleed-off manifold fluidly connected to the single primary inlet and single primary outlet. Further, different configurations of bleed-off manifolds may be envisioned having one or more main passageways with one or more valved bleed-off outlets to allow selected bleed-off of fluid flowing into or out of the primary inlet or outlet of a well isolation unit.

Well isolation units according to embodiments of the present disclosure (e.g., well isolation unit 100) may include a skid (e.g., skid 102 shown in FIG. 1) on which components of the wellbore isolation unit are disposed. In the embodiment shown in FIG. 1, the skid 102 may include a framed structure in which components of the well isolation unit 100 are mounted. The skid 102 may allow all components of the well isolation unit 100 to be moved or transported together in assembled form.

According to embodiments of the present disclosure, a well isolation unit may be completely assembled on a frame of a skid, such that the assembled well isolation unit is in operational state once connected to other operational wellbore operation equipment (e.g., the well isolation unit 100 may be operational once the inlet 104 is connected to pump-side equipment and the outlet 108 is connected to well-side equipment), and wherein the completely assembled well isolation unit may fit within and be transported on the skid. For example, the components of the well isolation unit may be able to be assembled away from a wellbore site, and transported to the wellbore site. The well isolation unit may be able to be tested before transportation to the wellbore site. The well isolation unit may be able to be tested after transportation to the wellbore site, but before assembly of the well isolation unit with other wellbore operation equipment.

A well isolation unit according to embodiments disclosed herein may be assembled on a skid and transported to a wellbore operation system for integration into the wellbore operation system (e.g., by connecting the single primary inlet 104 of a well isolation unit 100 and the single primary outlet 108 of the well isolation unit 100 to connections of the wellbore operation system). A well isolation unit according to embodiments of the present disclosure may be connected into wellbore operation systems used to perform hydraulic fracturing operations (where the term "fracturing" is often substituted for the abbreviated term "frac" in the hydraulic fracturing industry), such as conventional frac pad systems or a modular frac pad system according to embodiments of the present disclosure. A modular frac pad system may also be interchangeably referred to as a modular skid system in the present disclosure.

A modular frac pad system, according to embodiments herein, is a system in which the elements of a frac system are modularized and deployed on connectable skids (e.g., skid 102 shown in FIG. 1) that can be secured together to form an integrated frac structure capable of spanning from the outlet of a frac pump to a wellhead. The frac system elements are modularized in a way such that the primary manifolds/flow functionality is made up when the skids of the modular frac pad system are connected. The reduction of using non-uniform connections that must be made up and pressure tested may significantly reduce the complexity, design, time, and weight of the system. Additionally, the modular frac pad system may be used to direct fluid produced from or injected into a well. As used herein, fluids may refer to proppant, liquids, gases, and/or mixtures thereof. Other instruments and devices, including without limitation, sensors and various valves may be incorporated within a modular frac pad system.

Conventional frac pad systems in the oil and gas industry typically consume a large amount of space and resources of a rig area. Conventional frac pad systems may use elements that are individually designed and sized with pipes, flow lines, and other conduits being used to interconnect the conventional frac pad systems. Furthermore, pipes, flow lines, and other conduits being used to interconnect the conventional frac pad systems are not uniform and take valuable time to make up and pressure test. Additionally, the sheer number of pipes, hoses, and other fluid connections represent safety hazards for on-site workers. This additional need of more components needed to interconnect the conventional frac pad systems adds to the weight, installation costs, and overall cost of the conventional frac pad systems.

Accordingly, one or more embodiments in the present disclosure may be used to overcome such challenges as well as provide additional advantages over conventional frac pad systems, as will be apparent to one of ordinary skill. In one or more embodiments, a modular frac pad system (which may also be referred to as a modular skid system) may include purpose built, same-sized skids that are connected together to form a multi-functional uniform manifold with a limited number of connections that must be made up. As used herein, purpose built modular skids (or modular units) may include modular skids according to embodiments of the present disclosure having known and/or new equipment configurations that serves a certain purpose or performs a certain job. For example, a modular skid according to embodiments of the present disclosure may be a well isolation unit, as described herein, where the well isolation unit modular skid may be purpose built to selectively isolate flow of fluid through the modular skid and/or to bleed-off fluid from the well isolation unit. Other equipment types currently known and/or unknown in the art may be utilized in modular skids according to embodiments of the present disclosure.

Modular skids according to embodiments of the present disclosure may have standardized uniform mounting footprints, whether same-type or different-type equipment is mounted to the modular skids. In other words, a modular skid system according to embodiments of the present disclosure may include modular skids having same and/or different equipment configurations held on each modular skid, where each modular skid in the modular skid system may have the same mounting footprint. As used herein, a mounting footprint may refer to the size (width and length) of a base of a modular skid. Thus, in one or more embodiments, modular skids having different equipment units may have the same mounting footprint whether or not the different equipment units have different heights and/or elements of the different equipment units have different dimensions that swing or extend outward of the modular skid frame. For example, a modular skid system according to embodiments of the present disclosure may have a first modular skid with one or more elements of the equipment (e.g., a valve actuator or a valve connection flange) at a height above the first modular skid base and extending a distance outside of the first modular skid base width/length dimensions, and a second modular skid with an equipment unit configuration different from the first modular skid equipment, where both the first and second modular skids may have the same base width/length dimensions).

As described above, each modular skid in a modular skid system according to some embodiments of the present disclosure may have the same mounting footprint. However, in some embodiments, such as described in more detail below, a modular skid system may include one or more modular skids having a mounting footprint with one or more irregularities compared with the mounting footprints of the remaining modular skids, such that the modular skids in the modular skid system have substantially the same mounting footprints (i.e., have the same general widths and lengths not including the one or more irregularities). For example, in some embodiments, a modular skid system having modular skids with bases of the same general width and length and with connection points at axial ends of the base length may include a modular skid having base with an additional connection point extending past the width of the majority of the base, while the remaining modular skids in the modular skid system may have bases without such irregularities in the base width formed by an additional connection point.

The size of modular skids (including the size of modular skid mounting footprints, modular skid heights, equipment configurations arranged on the modular skids, etc.) may be selected based, for instance, on the size limitations of common transportation means, Department of Transportation (DOT) requirements (e.g., to meet weight and size limits of loads being transported on roads by trailers), the type of function each modular skid is to perform, and/or to provide reduced cost and reduced time to manufacture. For instance, the size of the mounting footprint of modular skids may be selected so that three modular skids may fit end to end on a flatbed trailer. In some embodiments, the overall size of modular skids (including the mounting footprints and the size of the equipment held on the modular skids) may be selected such that one or more modular skids may be mounted to a flatbed trailer and also meet DOT regulations for transporting the loaded flatbed trailer.

Using the modular frac pad systems according to embodiments of the present disclosure may reduce or eliminate the need for extensive non-uniform connections since the modular frac pad system is modularized and may be deployed on connectable skids to reduce the number of connections to other equipment. Further, modular frac pad systems according to embodiments of the present disclosure can be tailored to meet the specific job requirements needed (Rate, number of pumps, etc.), for example, by adding or subtracting a number of a certain purpose-type modular skid and/or by rearranging the connection pattern of modular skids. Overall a modular frac pad system according to embodiments of the present disclosure may minimize product engineering, risk associated with non-uniform connections, reduction of assembly time, hardware cost reduction, and weight and envelope reduction.

In one or more embodiment, a modular frac pad system may use a modular skid system which connects to at least one wellhead. One skilled in the art will appreciate how the modular skid system is not limited to a set number of wellheads. Additionally, the modular skid system may couple with the wellhead(s) by using at least one Time and Efficiency (TE) manifold skid or zipper manifold skid. The at least one zipper manifold skid may be designed to align with the spacing of the wellheads. In some embodiments, the space between wellheads may be between six feet and thirty feet. The at least one zipper manifold skid may be able to be arranged close to wellheads on a frac tree with any spacing. If the wellheads are spaced irregularly, one skilled in the art will appreciate how piping may be used to couple the wellheads to the at least one zipper manifold skid. In one or more embodiments, the modular skid system may include at least one articulating frac arm (AFA) skid, at least one ePRV/auxiliary skid, at least one pop-off/bleed-off tank skid, and at least one well isolation unit skid (e.g., as described herein). The skids may align together to form a super structure. One skilled in the art will appreciate how the modular skid system is not limited to a set number of skids but may have any number skids needed to perform a required job parameter.

Figure 3A:
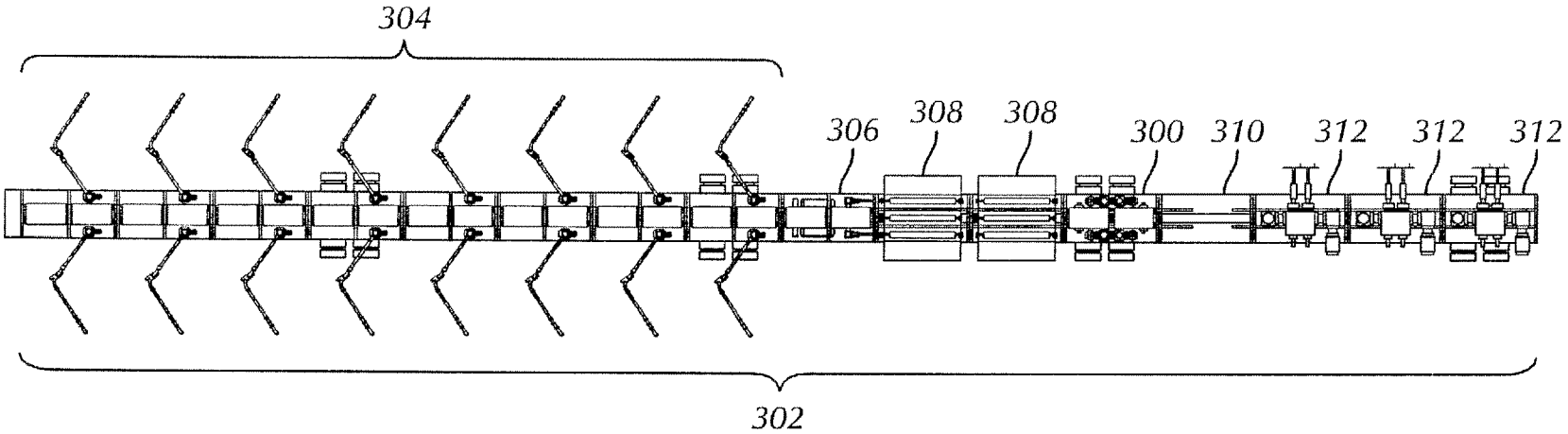
FIG. 3*a* is a top view of a modular system in accordance with the present disclosure.
Figure 3B:
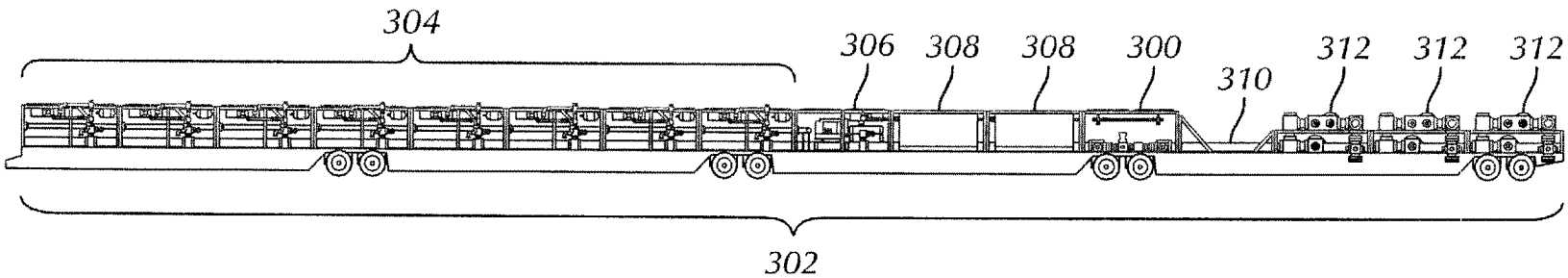
FIG. 3*b* is a side view of a modular system in accordance with the present disclosure.

FIGS. 3*a* and 3*b* show a top view and a side view, respectively, of an example of a modular system for a wellbore operation that includes multiple connected-together modular units being built from a plurality of same-size, purpose built skids. According to embodiments of the present disclosure, a well isolation unit (e.g. well isolation unit 100 shown in FIG. 1) may be designed as a part of a modular system of wellbore operation equipment (e.g. the system 302 shown in FIGS. 3*a* and 3*b*). In such embodiments, the well isolation unit may be designed to mate with other modular units of the modular system in an end-to-end manner.

FIGS. 3*a* and 3*b* show a modular skid system 302 which includes a plurality of connected-together modular skids. The modular skids include a well isolation unit 300. Pump-side equipment is shown to the left of the well isolation unit 300 in FIGS. 3*a* and 3*b*. The pump-side equipment may include one or more AFA modular skids 304, which may be used to connect to multiple positive displacement pumps (which may be referred to as frac pumps) of the fracturing system, an auxiliary modular skid 306, which may provide power and control to the components in the modular skid system and include one or more pressure relief valves (e.g., 2 pressure relief valves) for the pump-side equipment, and one or more pop-off/bleed-off tanks 308 connected to the bleed-off manifold in the well isolation unit 300, which may be used to store wellbore fluid that is bled off from the modular system 302. Well-side equipment is shown to the right of the well isolation unit 300 in FIGS. 3*a* and 3*b*. The well-side equipment may include a spacer skid 310 and one or more TE manifold skid 312. The spacer skid 310 may allow other pods to be positioned correctly relative to pumps and wells. The TE manifold skids 312 may connect to wellbores. In some embodiments, the modular skid system 302 may include any combination of the modular skids described above, arranged in different configurations.

In one or more embodiments, modular skids may include a primary inlet/primary outlet manifold connection mounted on a same-sized A-frame skid. Further, the primary inlet/primary outlet manifold connection extends a length of the skids. The same-sized A-frame skid may have a base with frame beams extending upward from the base. Additionally, the frame beams may be angled inward and connected with a top beam to create an A shape. The top beam may extend from one side of the length of the same-sized A-frame skid to another end of the length of the same-sized A-frame skid. It is further envisioned the same-sized A-frame skid may be any shape suitable to encompass the required equipment and is not limited to being the same-sized skids. The primary inlet/primary outlet manifold connection and same-sized A-frame skid may allow for the number and order of the skids to be easily changed depending on frac pad design considerations or well conditions. Additionally, the primary inlet/primary outlet manifold connection may simplify the number of connections needed system wide, as a maximum of two primary inlet/primary outlet manifold connections may need to be made up at any time. The modular skids of a modular skid system may be configured in a Tee configuration (i.e., where the modular skids are connected together to form a T-shape) or in another configuration having perpendicular bends. In one or more embodiments, the modular skids of a modular skid system may be in a straight or linear configuration. One skilled in the art will appreciate how the modular skid system is not limited to a set configuration and may be adapted to any configurations based on the job requirements.

Modular skids of a modular skid system may be mounted onto at least one trailer chassis prior to deployment to the field. The modular skids use ISO blocks (connection blocks in accordance with standards of the International Organization for Standardization) and twist locks to mount to the at least one trailer chassis. Multiple trailers chassis may be used depending on the number of modular skids being used. When using multiple trailer chassis, the trailer chassis may be aligned and joined using similar technology to removable gooseneck trailers. In mounting the modular skids to the at least one trailer chassis, a field rig-up time is significantly reduced. As stated above, the at least one trailer chassis may allow for different configurations per job requirements. Additionally, in using the same-sized A-frame skid, the modular skids may have identical mounting footprint, regardless of function. However, it is further envisioned that the modular skids may be transported to the field and placed on a ground or another platform instead of using the at least one trailer chassis.

Further, the modular skids may be connected together to form a unitary skid structure or super structure. In the super structure, the modular skids are pulled together and aligned. When the skids are aligned, elements on the skids may also be aligned, including ends of a primary inlet/primary outlet manifold connection. In that manner, the primary inlet/primary outlet manifold connection ends may be aligned and connected without worrying about the axial alignment of the pipes, and thus, the super structure may form a primary, high pressure manifold made up of big bore pipe segments. One skilled in the art will appreciate how rotationally independent connectors can be used in conjunction with a frac manifold alignment system so that a rotational alignment of the primary inlet/primary outlet manifold connection can also be ignored. Furthermore, in one or more embodiments, one or more alignment systems may be used to facilitate an automated alignment process, or at least a simplified alignment process in which one or more of the axial or rotational alignments may be more easily performed.

As described above, modular skids Tray be aligned and connected to form a super structure. A frac manifold alignment system may be used to properly align the modular skids together. The frac manifold alignment system may increase a speed at which the modular skids can be deployed and pressure tested in the field. A first modular skid and an adjacent second modular skid may each have a primary inlet/primary outlet manifold connection, where adjacent primary inlet/primary outlets of the adjacent modular skids may be connected together. For example, the inlet manifold connection of the well isolation unit 100 shown in FIG. 1 may be the inlet 104, and the outlet manifold connection of the well isolation unit 100 shown in FIG. 1 may be the outlet 108.

Furthermore, adjacently positioned modular skids may each have a support structure which surrounds the primary inlet/primary outlet manifold connection. A frac manifold alignment system may include various elements disposed on the support structures (e.g., on the frames of the modular skids) to align the adjacently positioned modular skids. For example, the elements of the frac manifold alignment system may include a plurality of male cones, a plurality of female cones, and a temporarily mounted hydraulics. The male cones may act as a guide to properly align a first modular skid with the female cones of an adjacently positioned second modular skid, and as such, the male cones may be inserted into to the female cones in a direction of connection. Furthermore, temporarily mounted hydraulics may be configured to draw the support structures, together. One skilled in the art will appreciate how temporarily mounted hydraulics may be added to the support structures at any time to aid in pulling adjacently positioned modular skids together or apart. Once drawn together, the ends of the primary inlet/primary outlet manifold connections may contact one another in axial alignment such that they can be secured together and pressure tested. In one or more embodiments, one or more rotationally independent connectors, e.g., clamps, (such as a Grayloc hub) KL4 connectors, can be used to avoid the need to rotationally align a flanged connection between the primary inlet/primary outlet manifold connections. One skilled in the art will appreciate how the rotationally independent connectors may be attached to the end of one of the pipe segments to reduce the amount of work necessary to make up the connection.

Embodiments disclosed herein may also generally relate to a method of isolating the well-side equipment of a wellbore operation system from the pump-side equipment of a wellbore operation system and either bleeding off the well-side equipment or bleeding off the pump-side equipment. An example of such method will now be described with reference to FIG. 1.

During a wellbore operation, flow of fluid may be permitted from pump-side equipment to well-side equipment and flow of fluid may not be permitted from well-side equipment to pump-side equipment. When fracturing operations are performed as described above, one or more check valves 114*a*, 114*b*, and 114*c* in a well isolation unit 100 may permit flow of fluid from pump-side equipment to well-side equipment, but not vice versa. In this way, the well isolation unit may protect pump-side equipment from any potential pressure build-up in the wellbore or in the well-side equipment.

In some embodiments, during a wellbore operation, flow of fluid may be permitted through a primary flow path, where valves in the wellbore operation system to secondary flow paths may be closed to prevent fluid flow through the secondary flow paths. For example, during a wellbore operation using a wellbore operation system as described above, flow of fluid may be permitted through the one or more intermediate flow pathways 112*a*, 112*b*, and 112*c* of a well isolation unit 100, and flow of fluid may not be permitted through the bleed-off manifold 120. The first bleed off manifold valve 122, the second bleed off manifold valve 128, and the one or more bleed-off outlets 132*a* and 132*b* may be configured to have closed configurations during a wellbore operation to prevent flow of fluid through the bleed-off manifold 120.

At a point in time during a wellbore operation, fluid flow in any direction through the wellbore operation system may be prevented. Preventing fluid flow in any direction through the wellbore operation system may temporarily or permanently halt the wellbore operation system. For example, during a wellbore operation using a wellbore operation system as described above, fluid flow in any direction through the wellbore operation system may be prevented, for example, by configuring the one or more plug valves 116*a*, 116*b*, and 116*c* of the well isolation unit 100 to have a closed configuration.

After fluid flow in any direction through a wellbore operation system has been prevented, it may be desirable to bleed-off pressure either from the well-side equipment or from the pump-side equipment. Pressure may be bled off from well-side equipment by placing the well-side equipment in fluid communication with an external holding vessel. Pressure may be bled off from the pump side equipment by placing the pump-side equipment in fluid communication with an external holding vessel. Both of these procedures will be described below in more detail for a wellbore operation using a wellbore operation system as described above, with reference to the well isolation unit shown in FIG. 1.

After fluid flow in any direction has been prevented through a wellbore operation system as described above, pressure may be bled-off from pump-side equipment. Pump-side equipment may be connected to the inlet 104 of the well isolation unit 100 prior to initiating the wellbore operation. The first bleed off manifold valve 124 of the bleed-off manifold 120 may be configured to have an open configuration. Fluid from the pump-side equipment may flow into the main passageway 130 of the bleed-off manifold 120. The one or more bleed-off outlets 132*a* and 132*b* may be connected to external holding vessels prior to initiating the wellbore operation. One of the one or more bleed-off outlets 132*a* and 132*b* may be opened to allow fluid to flow from the pump-side equipment into the external holding vessel connected to the bleed-off outlet 132*a* or 132*b*. It should be noted that any one of the bleed-off outlets 132*a* and 132*b* may be opened to allow fluid from the pump-side equipment to flow into a connected external holding vessel.

In some embodiments, after fluid flow in any direction has been prevented through a wellbore operation system as described above, pressure may be bled-off from well-side equipment. Well-side equipment may be connected to the outlet 108 of the well isolation unit 100 prior to initiating the wellbore operation. The second bleed off manifold valve 128 of the bleed-off manifold 120 may be configured to have an open configuration. Fluid from the well-side equipment may flow into the main passageway 130 of the bleed-off manifold 120. The one or more bleed-off outlets 132*a* and 132*b* may be connected to external holding vessels prior to initiating the wellbore operation. One of the one or more bleed-off outlets 132*a* and 132*b* may be opened to allow fluid to flow from the well-side equipment into the external holding vessel connected to the bleed-off outlet 132*a* or 132*b*. It should be noted that any one of the bleed-off outlets 132*a* and 132*b* may be opened to allow fluid from the well-side equipment to flow into a connected external holding vessel.

In the method disclosed above, any of the valves discussed may be automated. A valve that is automated may be configured to have an open configuration or to have a closed configuration based on, for example, a user input, on a measurement of wellbore operation conditions, a configuration of another valve or set of valves, a configuration of other wellbore equipment, or any other input. A measurement of wellbore operation conditions may be made, for example, within the well isolation unit 100, within a wellbore connected to the well isolation unit 100, or within any piece of equipment connected to the well isolation unit 100. Any combination of the valves of the well isolation unit 100 (e.g., one or more or none or each of the check valves 114*a*, 114*b*, 114*c*, the plug valves 116*a*, 116*b*, 116*c*, the first bleed off manifold valve 124, the second bleed off manifold valve 128, and the bleed-off outlets 132*a*, 132*b*) may be automated. Any control system or combination of control systems known in the art may be used to control the automated valves.

Automation may allow the one or more intermediate flow pathways 112*a*, 112*b*, and 112*c* to be controlled simultaneously. Controlling the one or more intermediate flow pathways 112*a*, 112*b*, and 112*c* simultaneously may allow the flow of fluid through the wellbore operation system to be permitted entirely or halted (e.g., by closing each of the intermediate flow pathways to entirely halt flow or by opening each of the intermediate flow pathways to entirely permit flow therethrough). Automation may allow the one or more intermediate flow pathways 112*a*, 112*b*, and 112*c* to be controlled independently. Controlling the one or more intermediate flow pathways 112*a*, 112*b*, and 112*c* to be independently configured to have an open configuration or configured to have a closed configuration may allow the flow of fluid through the wellbore operation system to be permitted partially.

Well isolation units according to embodiments disclosed herein may be faster to set up and test than traditional well isolation equipment. The well isolation unit may allow pump-side equipment and well-side equipment to be isolated from each other more quickly than traditional well isolation equipment. The well isolation unit may be less likely to fail than traditional well isolation equipment, thus improving the safety of wellbore operations and reducing the likelihood of wellbore fluid leaking into the environment.

The well isolation unit disclosed herein may be capable of being simultaneously attached to multiple external holding vessels and directing wellbore fluid bled-off from the well-side equipment and/or from the pump-side equipment to any of the external holding vessels. In some embodiments, a well isolation unit may be connected to only one external holding vessel (e.g., via a single bleed-off outlet extending from a main passageway of a bleed-off manifold portion of the well isolation unit) and may be capable of directing fluid from either the well-side equipment or from the pump-side equipment to the same external holding vessel. In some embodiments, a well isolation unit may be connected to more than two external holding vessels (e.g., via more than two bleed-off outlets extending from one or more main passageways of a bleed-off manifold portion of the well isolation unit) and may be capable of directing fluid from the well-side equipment and/or from the pump-side equipment to the same external holding vessel or different external holding vessels. Thus, the well isolation unit may provide more options for bleeding off well-side and pump-side equipment than traditional well isolation equipment.

A well isolation unit according to embodiments disclosed herein may be capable of being used with a modular wellbore operation system, which may decrease the time needed prepare and test wellbore equipment. The well isolation unit may allow piping components with larger inner diameters than the piping components used in traditional wellbore operation systems to be used to perform wellbore operations, thus reducing the overall number of piping components needed to perform a given wellbore operation. Further, reducing the overall number of piping components may improve reduce the time and personnel needed to perform wellbore operations and improve the safety of the operations.

A well isolation unit according to embodiments disclosed herein may include automated valves. Automated valves may increase the speed with which the well isolation unit can respond to user input or wellbore operation conditions. This may improve the safety of wellbore operations and reduce the time and personnel required for wellbore operations.

While the disclosure includes a limited number of embodiments, those skilled in the art, having benefit of this disclosure, will appreciate that other embodiments may be devised which do not depart from the scope of the present disclosure. Accordingly, the scope should be limited only by the attached claims.

What is claimed is:

1. A well isolation unit comprising:

an inlet;

an outlet;

at least one flow pathway connected between the inlet and the outlet, wherein an inlet block is connected between the inlet and the at least one flow pathway, and an outlet block is connected between the outlet and the at least one flow pathway; and at least one bleed-off manifold connected between the inlet and the outlet, wherein an inlet connector of the at least one bleed-off manifold is connected to the inlet block and an outlet connector of the at least one bleed-off manifold is connected to the outlet block.

2. The well isolation unit of claim 1, wherein the at least one flow pathway comprises a check valve and a plug valve.

3. The well isolation unit of claim 1, wherein at least one valve disposed along the at least one flow pathway is hydraulically actuated.

4. The well isolation unit of claim 1, comprising three flow pathways connected in parallel between the inlet and the outlet.

5. The well isolation unit of claim 1, wherein the at least one flow pathway has an inner diameter less than an inner diameter of the inlet and the outlet.

6. The well isolation unit of claim 1, wherein the at least one flow pathway, the inlet and the outlet have an equal inner diameter.

7. The well isolation unit of claim 1, wherein the at least one bleed-off manifold comprises a first bleed off manifold valve, a second bleed off manifold valve, and one or more bleed-off outlets.

8. The well isolation unit of claim 1, Wherein the well isolation unit is disposed on a single skid.

9. A wellbore operation system comprising:

at least one pump;

a well isolation unit comprising:

an inlet;

an outlet;

at least one flow pathway connected to and extending between the inlet and the outlet, wherein at least one valve is disposed along the at least one flow pathway between the inlet and the outlet; and at least one bleed-off manifold connected between the inlet and the outlet;

well-side equipment disposed between a wellbore and the well isolation unit; and pump-side equipment disposed between the at least one pump and the well isolation unit.

10. The wellbore operation system of claim 9, wherein the inlet of the well isolation unit is connected to the pump-side equipment, and the outlet of the well isolation unit is connected to the well-side equipment.

11. The wellbore operation system of claim 9, wherein the well isolation unit is assembled to a skid.

12. The wellbore operation system of claim 9, wherein the bleed-off manifold includes one or more bleed-off outlets connected to one or more external holding vessels.

13. The wellbore operation system of claim 12, wherein the one or more external holding vessels are disposed on one or more same-sized skids.

14. A method comprising:

closing at least one valve positioned along at least one flow pathway between a single primary inlet and a single primary outlet in a well isolation unit to isolate well-side equipment of a wellbore operation system from pump-side equipment of the wellbore operation system, wherein the pump-side equipment is connected to the well isolation unit via the single primary inlet of the well isolation unit and the well-side equipment is connected to the well isolation unit via the single primary outlet of the well isolation unit, and bleeding off fluid from at least one of the well-side equipment and the pump-side equipment with at least one bleed-off manifold connected between the single primary inlet and the single primary outlet.

15. The method of claim 14, wherein bleeding off fluid comprises:

configuring a valve at one or more bleed-off outlet of the at least one bleed-off manifold to have an open configuration.

16. The method of claim 15, wherein the one or more bleed-off outlet is connected to one or more external holding vessel.

* * * * *